United States Patent [19]

Lembens

[11] 4,184,060

[45] Jan. 15, 1980

[54] PROCESS FOR DEVELOPING A TWO-COMPONENT DIAZOTYPE MATERIAL ON A NON-METALLIC CARRIER, WHICH MATERIAL CAN BE DEVELOPED BY THE INFLUENCE OF HEAT

[75] Inventor: Helmut Lembens, Wiesbaden, Fed. Rep. of Germany

[73] Assignee: Hoechst Aktiengesellschaft, Fed. Rep. of Germany

[21] Appl. No.: 854,242

[22] Filed: Nov. 23, 1977

[30] Foreign Application Priority Data

Nov. 25, 1976 [DE] Fed. Rep. of Germany ..... 2653461

[51] Int. Cl.[2] ..... H05B 9/06; G03C 5/18

[52] U.S. Cl. ..... 430/151; 219/10.55 R; 219/10.55 M; 354/298; 34/1; 219/10.55 A

[58] Field of Search ..... 219/10.55 A, 10.55 R, 219/10.55 M; 354/298, 299; 34/1, 4; 427/22

[56] References Cited

U.S. PATENT DOCUMENTS

| | | | |
|---|---|---|---|
| 3,462,285 | 8/1969 | Thompson | 427/22 |
| 3,470,343 | 9/1969 | Bilbrough | 219/10.55 A |
| 3,584,389 | 6/1971 | Hilton et al. | 219/10.55 A |
| 3,711,674 | 1/1973 | Admiraal | 219/10.55 |
| 3,785,821 | 1/1974 | Notley | 96/49 |
| 3,872,603 | 3/1975 | William et al. | 34/1 |
| 4,015,340 | 4/1977 | Treleven | 34/4 |

FOREIGN PATENT DOCUMENTS

| | | | |
|---|---|---|---|
| 2558589 | 7/1977 | Fed. Rep. of Germany | 219/10.55 A |

*Primary Examiner*—Bruce A. Reynolds
*Assistant Examiner*—Philip H. Leung
*Attorney, Agent, or Firm*—James E. Bryan

[57] ABSTRACT

This invention relates to an improvement in the process for developing a two-component diazotype material on a non-metallic carrier and which can be developed by the influence of heat, and contains, in particular, compounds which can be decomposed under the influence of heat and produce in this process an alkaline environment, the heat influence being produced by electromagnetic radiation radiated from a power transmitter, the improvement comprising subjecting the diazotype copying material to microwave radiation with a frequency higher than $10^9$ Hz without a heat-generating body being placed between the power transmitter and the diazotype material. The invention also relates to a developing device for developing the diazotype material.

23 Claims, 6 Drawing Figures

Figure 2:
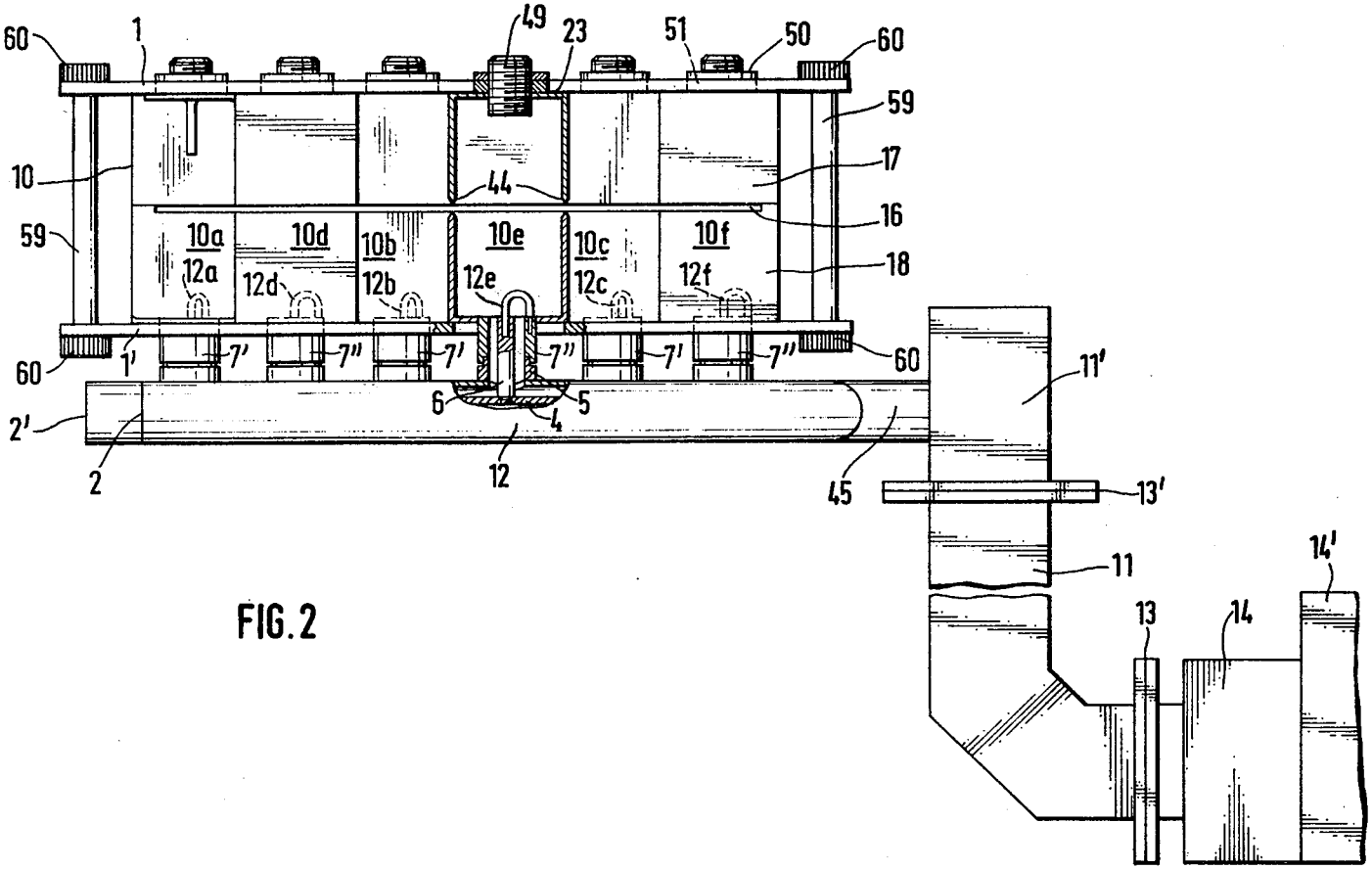

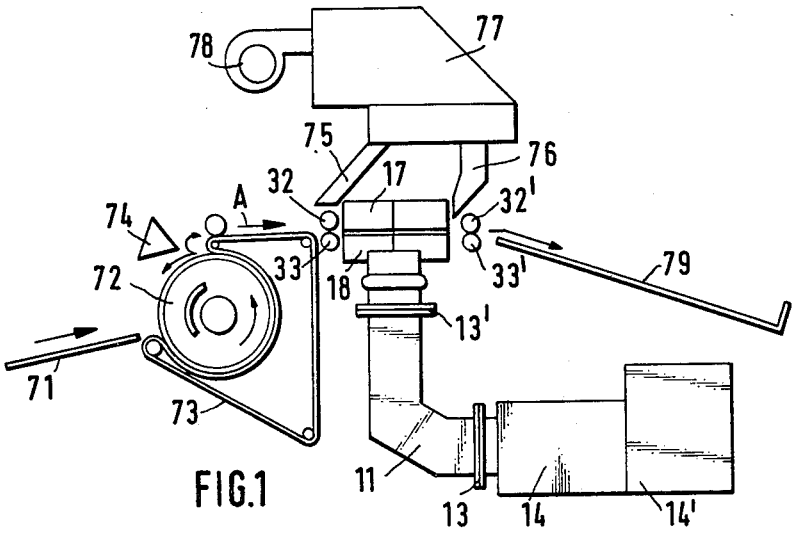
FIG.1
FIG.5
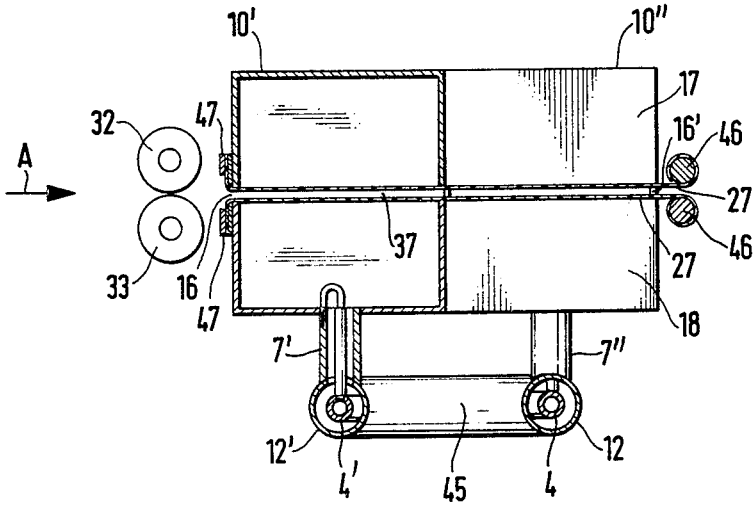

PROCESS FOR DEVELOPING A TWO-COMPONENT DIAZOTYPE MATERIAL ON A NON-METALLIC CARRIER, WHICH MATERIAL CAN BE DEVELOPED BY THE INFLUENCE OF HEAT

This invention relates to a process for developing a two-component diazotype material on a non-metallic carrier, which material can be developed by the influence of heat and contains, in particular, compounds which can be decomposed under the influence of heat and which produce in this process an alkaline environment, the heat influence being produced by electromagnetic radiation radiated from a power transmitter directly onto the two-component diazotype material and/or the carrier thereof.

The object of the present invention is to provide a suitable process fcr developing two-component diazotype materials by heat. In view of the known disadvantages in developing two-component diazotype materials in a water vapor/ammonia atmosphere, which disadvantages can be seen, in particular, in the ammonia-containing exhaust air therefrom and in the ammonia-containing waste water, an attempt has been made to carry out the development by the influence of heat alone (J. Kosar, Light-sensitive systems, 1965, pages 260 et seq). For this purpose it is conceivable to bring about the coupling of a diazonium salt component, which has not been decomposed by the influence of light, with a coupling agent, direclty by warming the components distributed in a layer. The problems, associated therewith, of providing a stable but light-sensitive system in which the diazo compounds do not decompose before coupling and in which the coupling takes place sufficiently rapidly, while at the same time an acceptable shelf life of the material is achieved, are, however, great. The difficulties mentioned are reduced if compounds are added to the layer of the two-component diazotype material, which under the influence of heat provide an alkaline environment, for example by splitting-off ammonia gas, which alkaline environment initiates the coupling process. Satisfactory results with such a development process depend, not least, on the manner the following, the problems associated therewith still will be dealt with; first, however, the following known components are listed (from German Patent No. 1,260,978) for closer characterization of the two-component diazotype materials which are to be developed.

Suitable light-sensitive diazo components are 4-dimethylaminobenzene-diazonium chloride, 4-morpholinobenzene-diazonium chloride or 4-pyrrolidino-3-bromobenzene-diazonium chloride, while suitable diazo components are 2,3-dihydroxy-naphthalene-6-sulfonic acid, 2-hydroxy-1,2-benzotriazole, 1,3,5-resorcylic acid diethylamide and 1-(N-ethylamino)-3-hydroxy-4-methylbenzene. Compounds which generate an alkaline environment are those which at normal ambient temperature do not give a neutral or alkaline reaction and only upon warming form a product which gives a neutral or alkaline reaction, such as ammonia gas, or compounds which, while they give an alkaline reaction at normal temperature, are brought to a higher state of aggregation by warming. These include, inter alia, the monoamides or oligoamides of organic, aliphatic, monobasic or polybasic carboxylic acids, for examle, of acetic acid, monochloroacetic acid, dichloroacetic acid and trichloroacetic acid, the diamides of carbonic acid, oxalic acid, fumaric acid or succinic acid, and especially the amides of the acids which still carry one or more hydroxyl groups in the aliphatic chain, such as the amides of malic acid, tartaric acid, citric acid, hydroxyacetic acid, hydroxybutyric acid and lactic acid. Examples of suitable carriers of the two-component diazotype material are paper (photocopying base paper) or transparent paper. However, in the context of the present invention, those carriers which are very good electrical or magnetic conductors, and especially metal carriers (aluminum), are unsuitable.

When warming the two-component diazotype material which contains compounds which under the influence of heat can be decomposed and thereby create an alkaline environment, the problem arises of developing the material such a way that, without decomposing the diazo component, the coupling takes place as rapidly and completely as possible in the entire layer without overheating parts of the layer, especially its outer surface, because this would promote the decomposition of the diazo component. At the same time, however, the compound which causes the alkaline environment should if possible be decomposed in such a way that the alkaline medium arrives rapidly and uniformly at—as far as possible—all points at which the diazo component and the coupling agent are contained in the layer.

To achieve this, the prior art already includes several development processes which are intended to warm the two-component diazotype material and/or the carrier thereof. In order to develop heat-developable diazo compounds as uniformly as possible, but without reaching the decomposition temperatures of the diazo compounds, by means of a hot surface in a closed space, it already has been disclosed to keep the surface of the material which is provided with the two-component diazo layer facing away from the hot surface and keep the other surface of the material at a distance from the hot surface (German Patent No. 1,260,978). The hot surface is in this generated, in particular, by a belt having a very high dielectric loss factor, which passes between two condenser plates which are connected to a high frequency generator. In this context, frequencies of about 10–20 MHz are used. The heat is not generated directly in the two-component diazotype material, but in a hot surface, namely the belt, which releases its heat to the surface of the material which is not provided with a two-component layer. This is intended to produce relatively little warming of the two-component layer, in order to avoid decompositions of the diazo layer, while on the other side a reaction can take place in the compound which produces a gas. The ammonia gas thereby evolved moves in all directions and in so doing also diffuses to the hot surface of the belt. There it is warmed and can pass relatively easily through the copying material and reach the diazo layer to be developed. However, this process has the disadvantage that the apparatus for carrying out the process must be supplied with a relatively large amount of energy, because the heat released by the hot surface is utilized only indirectly. Until the thermal conditions in the apparatus reach a stationary state, a heating-up time must be tolerated. The ammonia gas used for development can issue into the environment, because the action of this apparatus is based on the gas being exposed to the hot surface outside the two-component diazotype material and its carrier. Finally, the means for transporting the two-component diazotype material at a suitable distance from the hot surface are still relatively expensive.

The prior art also includes a method of generating, in a narrow reaction zone, with the aid of infrared radiators, the vaporizable material used for development which is present in free form or a bonded form in the reproduction material or in the two-component diazotype material. In so doing, provision is made that either the reproduction material itself or a second sheet carried with it absorbs the infrared rays and converts them to sensible heat. However, in this known process, the surface of the reproduction material is heated by far the most strongly, so that decomposition of the thermal diazo compound already may occur at the surface of the two-component layer before the vaporizable material required for the development has been generated in sufficient amount. In particularly disadvantageous cases, the carrier even can be damaged by the heat radiation. Where heating is effected indirectly by means of a second sheet which travels with the material, and which is subjected to infrared rays, significant heat transfer times must be expected, which further delays the development. Furthermore, with such an arrangement the utilization of the heat radiation is relatively poor.

The object, therefore, of the present invention is to provide a developing process of the type mentioned at the outset which makes it possible, without waiting for a starting-up period, fully to develop, rapidly and with good cover, two-component diazotype material which has, in particular, content of compounds which can be decomposed under the influence of the heat and which produce in this process an alkaline environment. This process is carried out with a relatively small energy requirement. Damage to the two-component diazotype material by decomposition of the heat-developable diazo compound and damage to the carrier are, however, avoided as far as possible. Pollution of the environment by the release of vaporizable material required for developing, as far as possible, does not occur.

In the process according to the invention, the release of the material producing an alkaline environment is effected directly by dielectrically heating the two-component diazotype layer and the carrier. The two-component diazotype material, on a carrier composed in particular of paper, is heated by the interaction of polar molecules or polar molecule groups with the alternating electric field of the electromagnetic oscillation. The frequency chosen is higher than $10^9$ Hz and is preferably 2450 MHz. It allows good heating in the interior of the two-component diazotype material with alternating electric field strengths which lie far below the breakdown field strength. material damage by arcing or excessive heating of the surfaces is reliably avoided. By heating in the interior of the two-component diazotype material, the alkaline environment is produced directly in, or in the immediate vicinity of, the components to be coupled. For creating this environment, virtually no heat transfer need be waited for so that over relatively short developing distances and with a relatively high throughput speed the two-component diazotype material is fully developed. In the proposed developing process the ammonia gas which is split-off can influence the components, which are to be coupled, in a concentration yet achieved under comparable conditions with regard to the heat energy fed to two-component diazotype material. It is a further advantage that heat development outside the diazotype material and its carrier is avoided without any further precautions. Because the developing distance can be short, a simple paper feed suffices. Overall, the constructional expenditure for the compact developing distance is small. Because there is no heat inertia in the process it is suitable for instant starting. It is not necessary to wait for the equipment to warm up. The process is environmentally favorable because no undesired heat is radiated externally nor do large quantities of ammonia gas have to be released. Not least, a device suitable for carrying out this process requires little maintenance.

The process for developing a two-component diazotype material, in which the diazotype material is transpforted through at least one ele tromagnetic radiation field is designed, in particularly appropriate manner, so that webs of the diazotype material, arranged adjacent to one anothr without gaps and running in the transport direction, are subjected to discrete radiation fields allocated to each web. By this further development of the process, a uniform development of the diazotype material can be acihieved over the large working width. This is particularly advantageous in photocopying technology. It is not necessarily to be expected, on the other hand, that the use of customary power transmitters radiating microwaves, namely antennae, provides uniform development because the amplitude spread of a segment antenna varies greatly, or in the case of a parabolic horn passes approximately sinusoidally via the aperture. Because the web of diazotype material which is to be developed and is moved to the power transmitter, is developed in seeveral webs which are parallel to one another and to the transport direction, it is, however, possible to achieve a high uniformity provided that the individual energy fields join one another without gaps.

For this purpose it is, in practice, particularly appropriate to use a microwave power transmitter. In this case no disturbing, unheated, or only slightly heated, positions on the diazotype material are caused finally even by the paths or walls of the individual transmitter elements, but rather the heated strips merge into a total surface developed through without gaps.

The process according to the invention and a developing device for carrying it out will be further illustrated by reference to the accompanying drawings in which:

FIG. 1 shows a schematic representation of a copying machine, in side view, with a developing device for two-component diazotype material.

Figure 3:
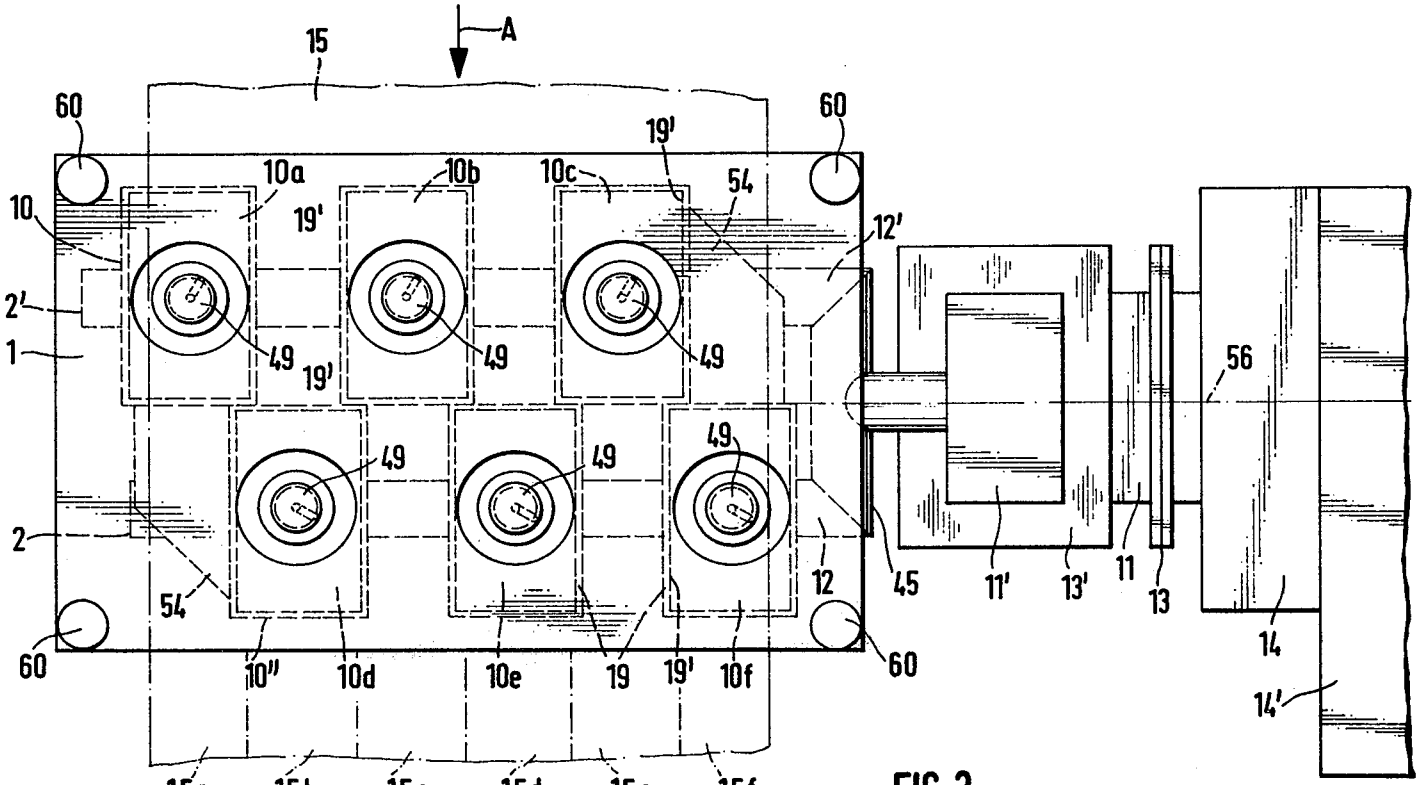
Figure 3A:
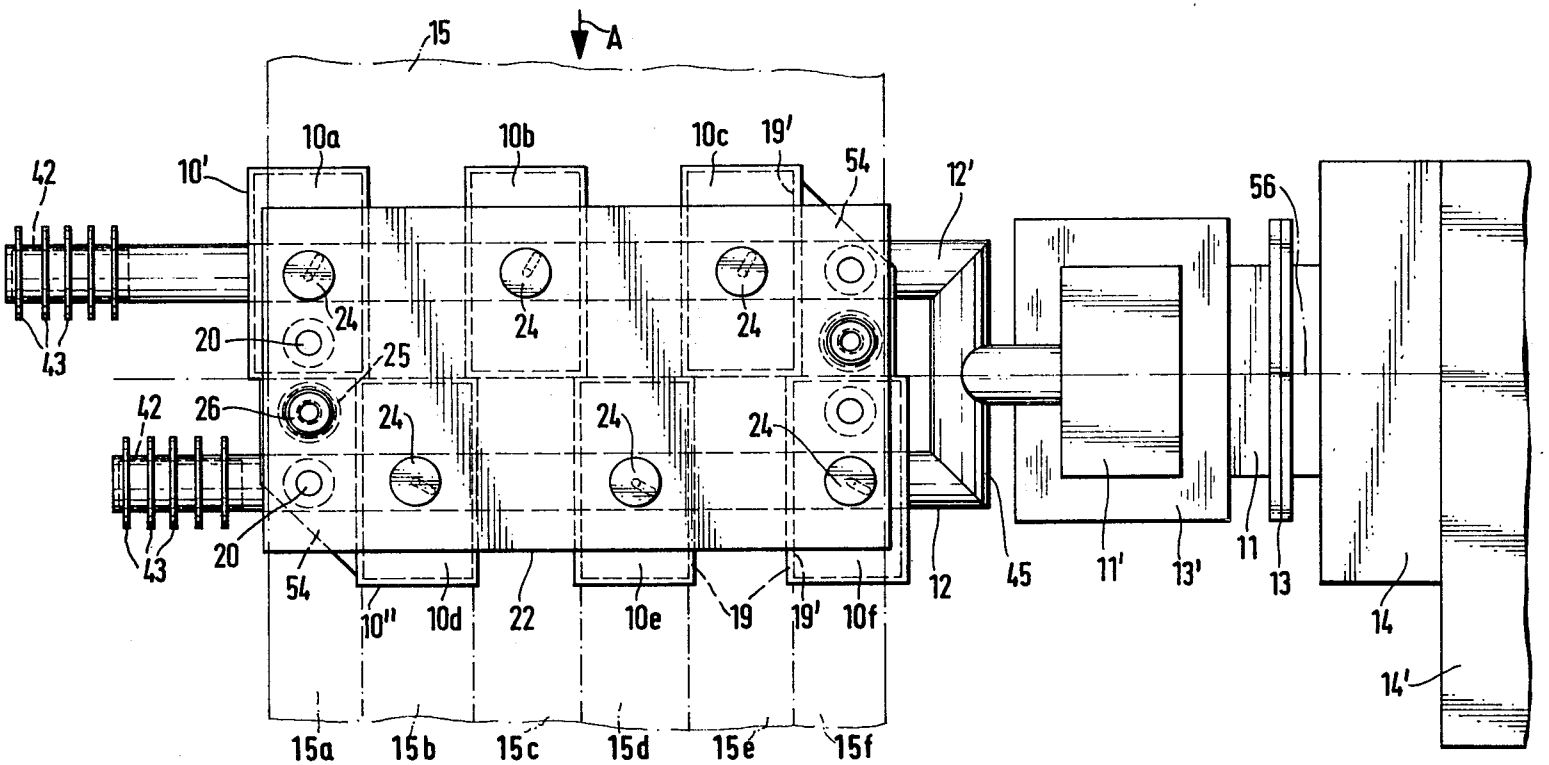
Figure 4:
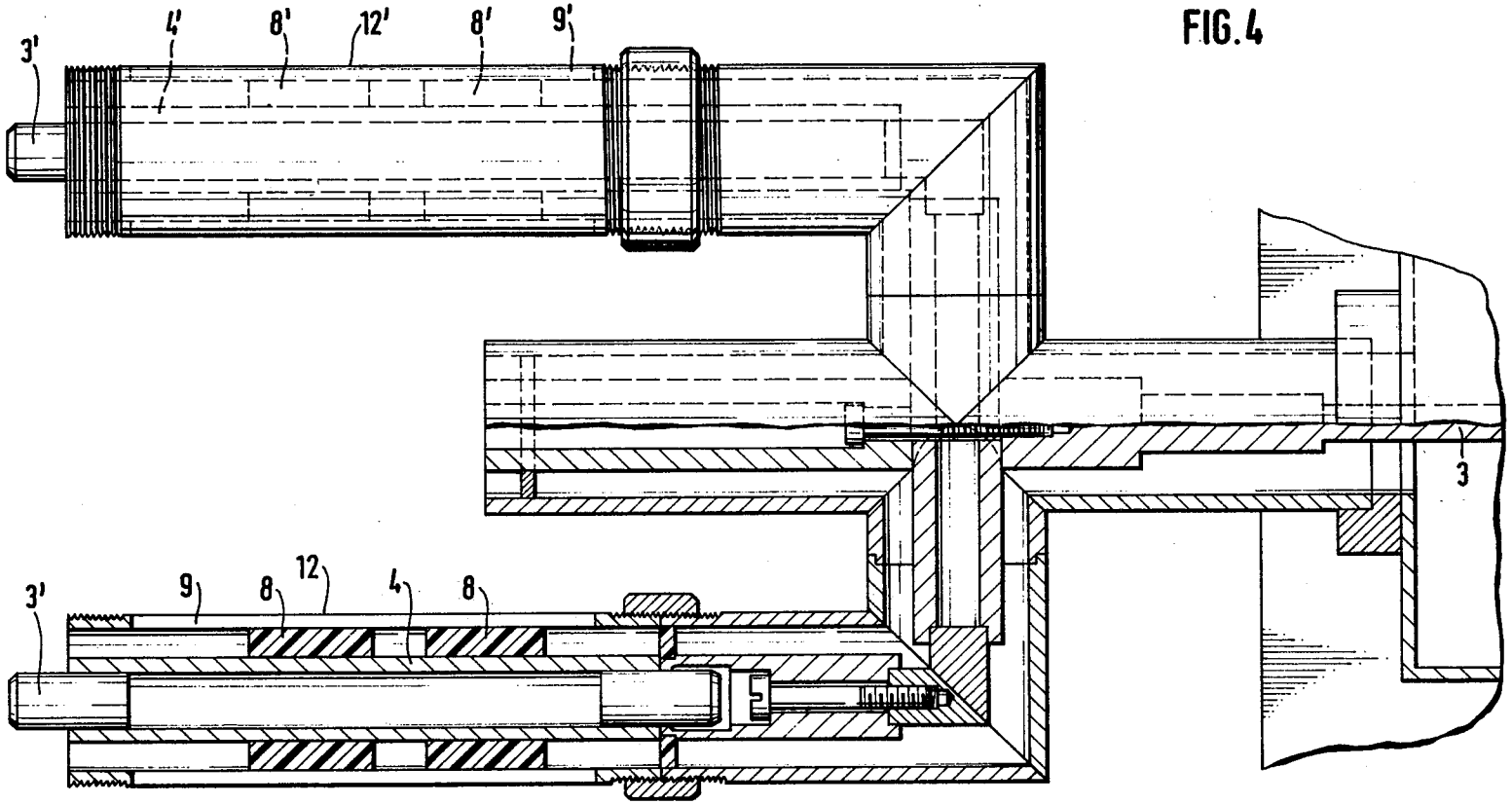

FIG. 2 shows a partial section through a part of the developing device, viewed from the front, which corresponds essentially to that according to FIG. 1, FIG. 3 and 3*a* each show a plan view of the transmitter elements, offset from each other in two rows, of the embodiment of the developing device according to FIG. 2 and of a similar embodiment, FIG. 4 shows a plan view of a T-junction between a waveguide and feeder lines of the developing device, and FIG. 5 shows a side view, in section, of a somewhat different embodiment of the developing device with rolls for guiding and further conveyance of the diazotype material through the microwave power transmitter.

In the figures the same parts are designated by the same reference numbers.

In the following text a copying machine with a developing device for two-component diazotype material is first discussed and then the process carried out with it is discussed, so far as it concerns the development of the exposed diazotype material.

In FIG. 1 a feeding-in of an original is designated by 71. The original is guided, togethr with a sheet of two-component diazotype material, through an exposure zone, by means of a belt guide 73 resting on a copying cylinder 72. At a separation position 74 the original is separated from the exposed diazotype copying material which is transported in the direction of the arrow A to the guide rolls 32, 33 at the entrance to a microwave transmitter with upper chambers 17 and lower chambers 18. The developed diazotype material leaves at the exit of the microwave transmitter and arrives on a stacker 79. The open end of a suction nozzle 75, 76 is located in each case in the vicinity of the entrance and of the exit of the microwave transmitter. The two suction nozzles end in a suction box 77 which is connected to a fan 78 for the removal of the exhaust air. The microwave transmitter is connected via a coupling member 13', a waveguide 11, and a further coupling member 13, to a microwave generator which is fed by a power supply 14'.

The microwave power transmitter 10, as represented in detail in FIGS. 2 and 3, is composed of a front row 10' and a rear row 10'' of transmitter elements **10*a–f* which are offset from each other. In the preferred embodiment, the transmitter elements are rectangular hollow waveguides, which are in themselves known, and which form the two-part chamber resonators with the upper and lower chambers 17 and 18, respectively. The two-part chamber resonators are fixed on two mounting plates 1,1' which are connected together in such a way that between the wide side of each upper chamber 17 and the wide side of each lower chamber 18, a through gap on the front and a gap on the rear are formed. The transmitter elements 10*a* –10*f* can be assembled on the unit assembly principle with the outer longitudinal walls 19 adjacent to one another to form the microwave power transmitter 10, in such a manner that the gaps on the front wide sides of the transmitter elements form an entrance gap 16 stretching over the web width of a carrier 15 of the diazotype material, and the gaps of the rear wide sides of the transmitter elements form an exit gap 16' as a passage for a carrier. The transmitter elements 10*a* to 10*f* in the two rows 10', 10'', for example, are offset transversely to the running direction arrow A of the carrier 15 so that the inside surfaces 19'**, of the transmitter elements following behind each other, overlap.

The upper mounting plate 1, on which the upper chambers 17 are fastened can be lifted, after release of knurled screws 60, so that all transmitter elements are accessible inside.

A waveguide 11 leads from the microwave generator 14, with a power supply 14', to the microwave power transmitter 10. A terminal member 11' of the shared waveguide 11 ends in a T-junction 45, to which two feeder lines 12, 12', parallel to each other, are joined, from which the coupling loops **12*a–f* branch, projecting into the corresponding transmitter elements 10*a–f* and inductively couple these to the feeder lines 12, 12'. The microwave generator 14** operates preferably at a frequency of 2450 MHz, with an alternating electric field strength which lies below the breakdown field strength so that material damaged by arcing is avoided with high reliability.

The feeder lines 12, 12' are designed coaxially and have inner hollow waveguides 4, 4'. The inductive coupling loops **12*a* to *c* of the front branch of the transmitter elements are each surrounded by a tube 7', and those of the rear branch each by a tube 7''**.

In the wall of the inner hollow waveguide 4, 4' a contact bolt 6 is screwed in vertically in the center line of each tube 7', 7'', the upper end of the bolt ending in the bottom of the lower chamber 18 of the corresponding transmitter element. The contact bolt 6 has a blind hole in which the end of the longer limb of the coupling loop is inserted. The curve of the coupling loop projects into the interior of the lower chamber 18, and the end of the shorter limb of the coupling loop is received by a hole in the cylindrical wall of the tube 7', 7''. The tube 7', 7'' rests on a tube nozzle 5 on the outside of the feeder lines 12, 12'. The transmitter elements or resonators of each branch, coupled inductively with their coaxial feeder line, are connected in parallel. The inductive coupling loops of the resonators of the front row 10' take up, in plan view, a position corresponding approximately to the one o'clock position, while the coupling loops of the rear row 10'' exhibit approximately the four o'clock position, in plan view (FIG. 3). The coupling loops of each branch also can take up a different position from that mentioned; the essential point being that they run parallel to one another within a branch.

A knee-shaped part of the waveguide 11 is joined at one end to the microwave generator 14 with the aid of a coupling member 13, while a further coupling member 13' joins the other end of the knee-shaped part of the terminal 11' of the waveguide 11. The T-junction 45 branches off at a right angle from the terminal member 11' of the waveguide 11, as shown in FIG. **3*a*. The waveguide 11, the T-junction 45 and the coupling loops 12*a–f*** also can take up a different position relative to one another from that represented.

On the entrance side the longitudinal slots 9, 9' are provided in the two feeder lines 12, 12' (FIG. 4) in which the short-circuit plungers 8, 8' made of plastic, such as for example polytetrafluoroethylene, can undergo sliding adjustment. The short-circuit plungers have the shape of small plates or blocks, and are connected in series as matching sections before the chamber resonators. With them the power supplied can be distributed to the chamber resonators, for example for carrier sizes such as the JB4 size (257 mm×364 mm) in the ratio 3/3, and the DIN A4 size (210 mm×297 mm) in the ratio 3/2. This means that with a JB 4 size the three chamber resonators, the front row as well as the rear row, are fully applied, whereas with a DIN A4 size the three resonators of the front row 10' and the two resonators of the rear row 10'', which in the running direction lie nearer to the right-hand edge of the carrier 15, are in operation, while the third resonator of this row 10'', furthest away from the right-hand edge, remains switched off.

The two branches of the T-junction 45 have coupling pins 3' at their ends which make the connection with the feeder lines 12, 12'. A further coupling pin 3 joins the T-junction 45 to the reactangular hollow waveguide of waveguide 11 without reflection.

The movable short-circuit plungers 8, 8' also can be replaced by fixed short-circuit plungers.

The fixing device has a certain power take-up in full operation which is set according to the number of transmitter elements and the width of the diazotype material to be developed on the carrier 15. Thus the problem arises as to how the energy not required on a possible completely empty running of the developing device, or a partially empty running, in the case of diazotype material to be fixed on a narrower-sized carrier, can be dissipated without the microwave generator 14 being thereby adversely affected. In the embodiment according to FIG. 3 this problem is solved in that a circular is used for the dissipation of the surplus energy converted into heat. Compared with other methods for dissipating surplus energy it has the advantage that with its aid a very accurate energy balance is possible. In the embodiment according to FIG. 3*a* terminal loads 42 are provided on the ends of the two feeder lines 12, 12', for the dissipation of the surplus energy.

In the embodiments according to FIGS. 2, 3 and 3*a*, three transmitter elements or resonators 10*a, b* and *c*, and 10*d, e* and *f* are located in each of the two rows 10', 10'' lying behind each other, but the invention is in no way limited to a six-chamber arrangement of this type. Rather, in most cases it will be appropriate to provide more than three transmitter elements in each row for developing diazotype material in photocopying technology.

In the embodiment shown, the lontiduinal walls 19 of the transmitter elements 10*a–f* are each aligned in the running direction of the carrier 15.

In order to achieve an optimum arrangement of the entire developing device with respect to uniformity of developing, the front and rear rows of the transmitter elements 10*a–f* are, as already mentioned, offset relative to each other so that the transmitter elements in the rows 10', 10'' mutually form a gap. The longitudinal walls 19 of the transmitter elements 10*a–f* are appropriately tapered in the direction of the carrier 15, in which case the longitudinal walls can, for example, have a taper 44 on the lower 10 mm down to a wall thickness of 1 mm or less. This measure, together with the measures described below, effects an adequate developing of the diazotype material carried past on the carrier 15, below the longitudinal walls 19 of the transmitter elements 10*a–f*. The further measures consist in the transmitter elements 10*a–c* of the front row 10' being offset relative to the transmitter elements 10*d–f* of the rear row 10'' by the wall thickness of the longitudinal wall 19 of a transmitter element in such a way, transverse to the running direction of the carrier 15, that the inside surfaces 19' of the longitudinal walls 19 of the transmitter elements of the front row are in alignment with the inside surfaces of the longitudinal walls 19 of the transmitter elements of the rear row forming a gap, as is represented by broken lines in FIG. 3*a*. It is, in some circumstances, even appropriate that the transverse off-setting of the two rows 10' and 10'' is chosen to be greater than the wall thickness of a longitudinal wall 19, so that the inside surfaces 19' of successive transmitter elements are not in alignment with each other, but in the transverse direction are at a distance from each other or overlap, as can be seen in FIG. 3.

An essential precondition for uniform developing is that the resonant frequency of the chamber is accurately tuned. For this purpose a tuning screw 49 is provided, in the cover surface 23 of each transmitter element, for setting the same chamber resonant frequency in all transmitter elements, which tuning screw engages with a nut 51 on the cover surface 23, and is locked by means of a lock nut 50. This tuning screw 49 projects in general several millimeters into the interior of the upper chamber 17 of each transmitter element. Planar conductive short-circuit end walls 2, 2' are provided in FIG. 3 for closing the feeder lines 12, 12', and these short-circuit walls are at a distance of approximately $\lambda_o/4$ from the first resonator of each branch, where $\lambda_o$ is the wavelength of the resonant oscillation.

It is also possible to construct the transmitter elements 10*a–f* without tuning screws or displaceable short-circuit plungers, in that the upper chambers 17 and the lower chambers 18 of the transmitter elements are each manufactured from a casting made with exact dimensions. Because of the exactly identical dimensions of the chambers of the individual transmitter elements these have identical resonance, so that a tuning of the energy density in the individual transmitter elements can be dispensed with. The construction of this embodiment of the invention is represented in FIG. 5, in which the upper and lower chambers 17, 18 of the transmitter elements, open to a carrier path 37 through the microwave power transmitter 10, are each closed with a film 27 made of plastic. These films 27 prevent ingress of dirt particles into the interior of the chambers, and thus contribute to a constant energy density in the transmitter elements. The films 27 can be made of, for example, polytetrafluoroethylene or copolymers of tetrafluoroethylene and hexafluoropropylene. Near to the entrance gap 16 a pair of guide rolls 32, 33 is provided for the transport of the carrier 15 coming from the direction A.

The films are advantageously fastened at one end on the outside of the outer transmitter element with the aid of clamping members 47, while the other ends of the films 27 are set under tension with the aid of the torsion springs 46, so that the films always have a smooth surface without any crease formation. The torsion springs 46 are provided near to the exit gap 16'.

With this developing device the diazotype material, which has been exposed on the copying cylinder and which runs into the microwave transmitter 10 via the two guide rolls 32, 33, is developed in an alternating electromagnetic field.

Where paper sheets are used as the carrier 15 of the diazotype material, the chamber-shaped cavity resonator with a $H_{101}$ fundamental oscillation is particularly suitable. The electric field possesses the highest possible field strength in the center of the chamber where the lines of force are directed parallel to the narrow side. The not excessively wide gaps in the plane of symmetry of the resonators between the upper and the lower chamber, which do not interrupt the alternating currents, do not couple any energy into the space outside. The diazotype material with its carrier is fed through these gaps for developing. The developing is then effected in adjacent webs 15*a–f* in FIG. 3, the width of which corresponds approximately to the inside distance between the chamber walls of the tansmitter elements, which chamber walls are aligned in the transport direction. The representation of the webs in the drawing serves merely to illustrate the invention because in reality they would not be distinguishable on the fully developed sheet of diazotype material. Because the lines of force in the gaps end on the inside of the metal chamber wall, i.e. they are deflected away from the plane of the diazotype material, the developing width of a web is, in general, approximately 1–2 mm narrower than the inside width of the resonators. Because of the overlapping of the edge zones the webs or strips of diazotype material developed by the individual chambers join together without gaps, so that wide sheets are uniformly developed. The relatively insignificant quantities of gas (ammonia) arising therefrom are drawn away by the suction nozzles 75, 76 at the entrance and exit of the microwave transmitter.

The devices shown in FIGS. 2–5 are designed for developing two-component diazotype material with a width of 210 mm and 257 mm. The JB 4 size is fed, for example, symmetrically through the developing device, the DIN A4 size, on the other hand, asymmetrically, the righthand carrier edges being fed along the same line.

In the first case all six, and in the second case only five, chambers are loaded. Thus there are two different operating settings, i.e., different immersion depth of the tuning screws 49 and setting of the matching sections in the circuit, such as short-circuit plungers, which regulate the power distribution.

The oscillation is damped by the resistance of the carrier of the diazotype material 15, but because of the connection in parallel it is also influenced by the impedance of the remaining chambers.

The resonance-tuning is achieved by the immersion depth of the tuning screws 49 and by the height adjustment of the upper chambers 17. The coupling loops 12*a*, 12*b* . . . by their shape, size and level setting determine also the resonance behavior. A fixed setting, which is the same for all resonators, was chosen for the coupling loops, i.e. the coupling was fixed. UHF currents can flow via the separation surfaces of the tuning screws 49. Because no transverse currents flow on the inside wall of the chamber perpendicularly to the separation plane, no UHF energy can leave the narrow gaps. Because of slight distortions in the field the gaps, of about 4 mm, deliver in any case insignificant scattered radiation of approximately 1–2 mW/cm$^2$, and this is not dangerous.

The $H_{101}$ resonators of each row, coupled inductively with their corresponding coaxial feeder lines 12, 12', are uniformly loaded by the diazotype material on its carrier 15 running through. Admittedly, when the carrier runs through, the two rows are not loaded uniformly, but first the front row 10' then the front and rear row 10', 10'' and lastly the rear row 10''.

Each resonator behaves, depending upon the resonant frequency, as a parallel resonant circuit of discrete components, which is strongly damped by the effective resistance of the diazotype material with its carrier 15, depending upon its electric and magnetic properties. For this reason the process is not suitable for developing diazotype material on a metallic carrier, such as is used, for example, for printing plates.

In the embodiment according to FIG. 3 in particular, the energy coming from the microwave generator 14, after passing through a circulator and feeding into the T-junction, is divided between the two feeder lines 12, 12', specifically according to the setting of the matching sections in the circuit for 210 mm or 257 mm widths of carrier. It is transmitted accordingly by the $H_{101}$ chamber resonators onto the carrier 15 and the exposed diazotype material.

Heat-developable diazo paper (A4 of Messrs. Kalle Niederlassung der Hoechst AG), which already had been stored for 8 years, was developed under trial conditions which had not yet been optimized. The heat-developable diazo paper contained, as the thermolabile developing substance, a N,N-disubstituted biuret of the formula

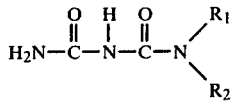

in which $R_1$ and $R_2$ denote alkyl, cycloalkyl, aralkyl or aryl groups or conjointly with the nitrogen atom to which they are bonded, form a heterocyclic radical. The heat-developable diazo paper had a working width of 210 mm and a paper weight of 80 g/m$^2$. It was fully developed without any faults by microwave radiation with a frequency of 2450 MHz with 600 W power output (connected load 1 KW) in five adjacent webs. The throughput speed of the heat-developable diazo paper in the microwave power transmitter in this case amounted to 15 m/min.

It will be obvious to those skilled in the art that many modifications may be made within the scope of the present invention without departing from the spirit thereof, and the invention includes all such modifications.

What is claimed is:

1. In the process for developing a two-component diazotype material on a non-metallic carrier which can be developed by the influence of heat, and contains, in particular, compounds which can be decomposed under the influence of heat and produce in this process an alkaline environment, the heat influence being produced by at least one electromagnetic radiation radiated from a power transmitter through which radiation the diazotype material is transported, the improvement comprising subjecting the diazotype copying material to microwave radiation with a frequency higher than $10^9$ Hz without a heat-generating body being placed between the power transmitter and the diazotype material, and using a uniformly radiating microwave power transmitter, extending across a web width of the two-component diazotype material, composed of a number of discrete transmitter elements which are arranged in at least two rows one behind the other in a running direction of the carrier, a shared waveguide for the power supply to the transmitter elements from a microwave generator to the microwave power transmitter and a T-junction branching from the waveguide to connect with the feeder lines which are coupled to the corresponding transmitter elements via coupling loops.

2. A process for developing a two-component diazotype material according to claim 1 including subjecting webs of the diazotype material arranged adjacent to one another running in the transport direction to discrete radiation fields allocated to each particular web.

3. A process according to claim 1 including the use of a microwave power transmitter with a straight entrance gap in the transmitter elements of a front row stretching over the web width of the carrier and a similar exit gap in the transmitter elements of a rear row.

4. A process according to claim 3 including the use of a microwave power transmitter in which a plane through the entrance gap and the exit gap divides the chamber-shaped transmitter elements into upper chambers and lower chambers.

5. A process according to claim 1 including the use of a microwave power transmitter in which a front and a rear rows of the transmitter elements are offset relative to each other, and the transmitter elements are arranged parallel to one another.

6. A process according to claim 5 including the use of a microwave transmitter in which the transmitter elements in the rows mutually form a gap.

7. A process according to claim 1 including the use of a microwave transmitter in which the transmitter elements are constructed as rectangular hollow waveguides, longitudinal sides of which are arranged in the running direction of the carrier.

8. A process according to claim 7 including the use of a microwave power transmitter in which the transmitter elements of a front row are offset relative to the transmitter elements of a rear row by a wall thickness of the longitudinal side of a transmitter element, in such a way transverse to the running direction of the carrier, that the inside surfaces of the longitudinal sides of the transmitter elements of the front row are in alignment with the inside surfaces of the longitudinal sides of the transmitter elements of the rear row forming a gap.

9. A process according to claim 7 including the use of a microwave power transmitter in which the transmitter elements of a front row relative to the transmitter elements of a rear row, are offset transverse to the running direction of the carrier in such a way that the inside surfaces of transmitter elements following behind each other overlap in the transverse direction.

10. A process according to claim 1 including the use of a microwave power transmitter in which a tuning member in a form of a tuning screw is provided, in a cover surface of each transmitter element, for setting same energy density in all transmitter elements.

11. A process according to claim 3 including the use of a microwave power transmitter in which upper and lower chambers of the transmitter elements, open to the carrier path, are each closed with a film made of plastic, to prevent ingress of dirt particles into the interior of the chambers.

12. A process according to claim 11 including the use of a microwave power transmitter in which the films are made of polytetrafluoroethylene or of copolymers of tetrafluoroethylene and hexafluoropropylene.

13. A developing device for developing two-component diazotype material on a non-metallic carrier, with a power transmitter radiating electromagnetic radiation, comprising a uniformly radiating microwave power transmitter, of a width sufficient to extend across a web width of the two-component diazotype material, including a number of discrete transmitter elements arranged in at least two rows one behind the other in a running direction of the carrier, a shared waveguide for the power supply to the transmitter elements from a microwave generator to the microwave power transmitter, and a T-junction branching from the waveguide to connect with feeder lines which are coupled to the corresponding transmitter elements via coupling loops.

14. A developing device according to claim 13 including a microwave power transmitter with a straight entrance gap in the transmitter elements of a front row of a width sufficient to stretch over the web width of the carrier and a similar exit gap in the transmitter elements of a rear rows together with at least one suction nozzle on the exit gap.

15. A developing device according to claim 14 including a microwave power transmitter in which a plane through the entrance gap and the exit gap divides the chamber-shaped transmitter elements into upper chambers and lower chambers.

16. A developing device according to claim 15 including a microwave power transmitter in which the front and the rear rows of the transmitter elements are offset relative to each other, and in which the transmitter elements are arranged parallel to one another.

17. A developing device according to claim 16 including a microwave power transmitter in which the transmitter elements in the rows mutually form a gap.

18. A developing device according to claim 13 including a microwave power transmitter in which the transmitter elements are constructed as rectangular hollow waveguides, longitudinal sides of which are arranged in the running direction of the carrier.

19. A developing device according to claim 18 including a microwave power transmitter in which the transmitter elements of a front row are offset relative to the transmitter elements of a rear row by a wall thickness of the longitudinal side of a transmitter element, in such a way transverse to the running direction of the carrier that the inside surfaces of the longitudinal sides of the transmitter elements of the front row are in alignment with the inside surfaces of the longitudinal sides of the transmitter elements of the rear row forming a gap.

20. A developing device according to claim 18 including a microwave power transmitter in which the transmitter elements of a front row relative to the transmitter elements of a rear row, are offset transverse to the running direction of the carrier in such a way that the inside surfaces of transmitter elements following behind each other overlap in the transverse direction.

21. A developing device according to claim 13 including a microwave power transmitter in which a tuning member in a form of a tuning screw is provided, in a cover surface of each transmitter element, for setting same energy density in all transmitter elements.

22. A developing device according to claim 14 including a microwave power transmitter in which upper and lower chambers of the transmitter elements, open to the carrier path, are each closed with a film made of plastic, to prevent ingress of dirt particles into the interior of the chambers.

23. A developing device according to claim 22 including a microwave power transmitter in which the films are made of polytetrafluoroethylene or copolymers of tetrafluoroethylene and hexafluoropropylene.

* * * * *

UNITED STATES PATENT AND TRADEMARK OFFICE

CERTIFICATE OF CORRECTION

PATENT NO. : 4,184,060

DATED : January 15, 1980

INVENTOR(S) : Helmut Lembens

It is certified that error appears in the above—identified patent and that said Letters Patent is hereby corrected as shown below:

Column 1, line 44, after "the", second occurrence, insert - - - in which heat is supplied to the two-component diazotype material. In - - - Line 53, "diazo" should read - - - azo - - -; line 66, "examle" should read - - - example - - -.

Column 2, line 16, after "material", the word - - - in - - - has been omitted; line 39, after "this", the word - - - case - - - has been omitted.

Column 3, line 51, "material" should read - - - Material - - -; line 63, after "tion" the word - - - not - - - has been omitted.

Column 4, line 11, "transp-" should read - - - trans- - - -; line 12, "forted" should read - - - ported - - -; line 15, "anothr" should read - - - another - - -; line 19, "acihieved" should read - - - achieved - - -; line 29, "seeveral" should read - - - several - - -.

Column 5, line 4, "togethr" should read - - - together - - -.

UNITED STATES PATENT AND TRADEMARK OFFICE

CERTIFICATE OF CORRECTION

PATENT NO. : 4,184,060

DATED : January 15, 1980

INVENTOR(S) : Helmut Lembens

It is certified that error appears in the above—identified patent and that said Letters Patent is hereby corrected as shown below:

Column 7, line 6, "circular" should read - - - circulator - - -; line 23, "lontiduinal" should read - - - longitudinal - - -.

Column 10, line 48, i.e., line 24 of Claim 1, "the" should be deleted after "with"; line 68, i.e., line 3 of Claim 5., "rows" should read - - - row -

Column 12, line 6, i.e., line 6 of Claim 14, "rows" should read - - - row - - -.

Signed and Sealed this

*Eighteenth* Day of *November 1980*

[SEAL]

*Attest:*

SIDNEY A. DIAMOND

*Attesting Officer* *Commissioner of Patents and Trademark*